US006575544B2

(12) United States Patent
Iriguchi

(10) Patent No.: US 6,575,544 B2
(45) Date of Patent: Jun. 10, 2003

(54) OPTIMIZING DRIVING PULSES PERIOD TO PREVENT THE OCCURRENCE OF SATELLITE DROPLETS

(75) Inventor: Akira Iriguchi, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/054,981

(22) Filed: Jan. 25, 2002

(65) Prior Publication Data

US 2002/0101464 A1 Aug. 1, 2002

(30) Foreign Application Priority Data

Jan. 30, 2001 (JP) ..... 2001-021568

(51) Int. Cl.[7] ..... B41J 29/38

(52) U.S. Cl. ..... 347/11; 347/10; 347/14; 347/17; 347/68; 347/69; 347/185; 347/186

(58) Field of Search ..... 347/10, 11, 14, 347/17, 68, 69, 185, 186

(56) References Cited

U.S. PATENT DOCUMENTS 5,764,256 A * 6/1998 Zhang ..... 347/11
5,980,013 A * 11/1999 Takahashi ..... 347/14
6,099,103 A * 8/2000 Takahashi ..... 347/11
6,106,092 A * 8/2000 Norigoe et al. ..... 347/11
6,109,716 A * 8/2000 Takahashi ..... 347/11
6,141,113 A 10/2000 Takahashi ..... 358/1.8
6,254,213 B1 7/2001 Ishikawa ..... 347/10
6,357,846 B1 * 3/2002 Kitahara ..... 347/10
2002/0047872 A1 * 4/2002 Ishikawa ..... 347/10

* cited by examiner

*Primary Examiner*—John Barlow
*Assistant Examiner*—Lam Nguyen
(74) *Attorney, Agent, or Firm*—Oliff & Berridge, PLC

(57) ABSTRACT

A drive device used for an ink droplet ejecting apparatus prevents an occurrence of a satellite ink droplet and improves printing quality. When ejection of an ink droplet is performed with two pulses and an ambient temperature surrounding a head is between low and medium, a pulse output period between first and second ejection pulses is set to be 5AL (AL=a cycle of a pressure wave in a pressure chamber/2). When ejection of an ink droplet is performed with three pulses and the ambient temperature surrounding the head is between low and medium, the pulse output period between first and second ejection pulses and between second and third pulses is both set to be 5AL.

19 Claims, 13 Drawing Sheets

| TEMPERATURE RANGE | DRIVING WAVEFORM | | |
|---|---|---|---|
| | PULSE INTERVAL | STABILIZATION PULSE | WAVEFORM |
| LOW | 5AL | NOT APPLIED | WAVEFORM A',C' |
| MEDIUM | 5AL | NOT APPLIED | WAVEFORM A',C' |
| HIGH | 4AL OR SHORTER | APPLIED | WAVEFORM B,D |

FIG.7A WAVEFORM A' USED AT BETWEEN LOW AND MEDIUM TEMPERATURES

FIG.7B WAVEFORM B USED AT HIGH TEMPERATURE

FIG.7C WAVEFORM C' USED AT BETWEEN LOW AND MEDIUM TEMPERATURES

FIG.7D WAVEFORM D USED AT HIGH TEMPERATURE

FIG.8

| TEMPERATURE RANGE | DRIVING WAVEFORM | | |
|---|---|---|---|
| | PULSE INTERVAL | STABILIZATION PULSE | WAVEFORM |
| LOW | 5AL | NOT APPLIED | WAVEFORM A',C' |
| MEDIUM | 5AL | NOT APPLIED | WAVEFORM A',C' |
| HIGH | 4AL OR SHORTER | APPLIED | WAVEFORM B,D |

FIG.9A WAVEFORM A

FIG.9B WAVEFORM B

FIG.9C WAVEFORM C

FIG.9D WAVEFORM D

FIG.12

DRIVING METHOD AND PRINTING RESULT

| TEMPERATURE RANGE | PULSE INTERVAL | STABILIZATION PULSE | EJECTION STABILITY | OCCURRENCE OF SATELLITE INK DROPLET |
|---|---|---|---|---|
| LOW | 3AL | APPLIED | ○ | ○ |
| | | NOT APPLIED | ○ | ○ |
| | 5AL | APPLIED | ○ | ○ |
| | | NOT APPLIED | ○ | ○ |
| MEDIUM | 3AL | APPLIED | ○ | △ |
| | | NOT APPLIED | × | × |
| | 5AL | APPLIED | △ | △ |
| | | NOT APPLIED | ○ | ○ |
| HIGH | 3AL | APPLIED | ○ | △ |
| | | NOT APPLIED | × | × |
| | 5AL | APPLIED | × | × |
| | | NOT APPLIED | × | × |

OPTIMIZING DRIVING PULSES PERIOD TO PREVENT THE OCCURRENCE OF SATELLITE DROPLETS

BACKGROUND OF THE INVENTION

1. Field of Invention

The invention relates to an ink droplet ejecting apparatus and method that produce a printed record by ejecting an ink droplet.

2. Description of Related Art

An ink jet print head used in a piezoelectric ink jet printer includes a cavity having a pressure chamber and a piezoelectric actuator provided adjacent to the pressure chamber in the cavity plate. A predetermined driving pulse is applied to the piezoelectric actuator, so that the volume of the pressure chamber is changed. With generation of a pressure wave in the pressure chamber according to the volume change of the pressure chamber, an ink droplet is ejected from an orifice. Further, a dot having a desirable density can be formed with a plurality of ink droplets by a plurality of driving pulses successively applied to the piezoelectric actuator at a time.

For example, when a dot having a high density is formed, two successive driving pulses are applied to the piezoelectric actuator to form a dot with two ink droplets.

However, at the time of ink ejection, there is a case where an ink droplet, which is an undesired ink droplet called a satellite ink droplet, may be produced other than a main ink droplet that is to form a dot, when the plurality of driving pulses are applied to the piezoelectric actuator as described above. This is caused by a residual pressure in the cavity. In a case where ink droplets are successively ejected by application of a plurality of driving pulses, a pressure wave remaining in the cavity does not completely flatten out after ejection of the main ink droplet, so that the undesired ink droplet is ejected by the residual pressure. The satellite ink droplet degrades the quality of printing, such as characters and images.

Therefore, in a conventional ink jet printer, a cancel pulse is included in a driving waveform to avoid occurrence of the satellite ink droplets. For example, when two driving pulses are applied to the piezoelectric actuator, a cancel pulse is applied after application of a second ejection pulse. Alternatively, a first cancel pulse is applied after application of a first ejection pulse and then a second ejection pulse is applied. After that, a second cancel pulse is applied. The cancel pulse reduces the residual pressure wave oscillation in the cavity after application of a preceding driving waveform. Though the application of the cancel pulse to the cavity develops a pressure in the cavity, the pressure is not strong enough to cause ejection of an ink droplet.

SUMMARY OF THE INVENTION

However, even when the cancel pulse is applied to the piezoelectric actuator as described above, the satellite ink droplets are produced or formed dots are deformed due to variations in quality of the ink jet print heads.

With the increase in the number of application of pulses, the pressure wave oscillation in the pressure chamber becomes complicated. Thus, there may be a case where the residual pressure is difficult to reduce.

The invention provides an ink droplet ejecting apparatus and method that prevents the occurrence of satellite ink droplets to improve printing quality.

According to an exemplary aspect of the invention, ejection of an ink droplet is implemented by a driving pulse being applied to an actuator provided in an ink droplet ejecting apparatus that includes a cavity plate having a pressure chamber for ejecting an ink droplet and the actuator that generates a pressure wave in the pressure chamber.

In the ink droplet ejecting method, an output period of a sequence of driving pulses is set to be five times of AL, where AL is the time in which a pressure wave propagates one-way within the ink chamber, when the sequence of the driving pulses are successively output to form one dot with a plurality of ink droplets in accordance with a printing command.

According to the ink droplet ejecting method of the invention, when the sequence of the driving pulses are successively output to form one dot with a plurality of ink droplets, the output period of the driving pulses is set to be five times of AL, where AL is the time in which a pressure wave propagates one-way within the ink chamber. Therefore, the residual pressure is reduced so that a second ink droplet is stably ejected in the appropriately reduced residual pressure. Consequently, ink droplets can be stably and successively ejected without consideration given to the amount of the residual pressure in the pressure chamber and the cancel of the residual pressure.

According to another exemplary aspect of the invention, an ink droplet ejecting apparatus includes a pressure chamber that contains ink, a nozzle that communicates with the pressure chamber and can eject the ink contained in the pressure chamber, an actuator that changes a volume of the pressure chamber, a driving pulse generator that generates a driving pulse to be applied to the actuator and a controller that allows the nozzle to eject an ink droplet therefrom by selectively applying the driving pulse generated by the driving pulse generator to the actuator to generate a pressure wave in the pressure chamber. In the ink droplet ejecting apparatus, the controller sets an output period of a sequence of driving pulses to be five times of AL, where AL is the time in which a pressure wave propagates one-way within the ink chamber, when the sequence of the driving pulses are successively output to form one dot with a plurality of ink droplets in accordance with a printing command.

According to the ink droplet ejecting apparatus, when the sequence of the driving pulses are successively output to form one dot with a plurality of ink droplets, the output period of the driving pulses is set to be five times of AL, where AL is the time in which a pressure wave propagates one-way within the ink chamber. Therefore, the residual pressure is reduced so that a second ink droplet is stably ejected in the appropriately reduced residual pressure. Consequently, ink droplets can be stably and successively ejected without consideration given to the amount of the residual pressure in the pressure chamber and the cancel of the residual pressure.

BRIEF DESCRIPTION OF THE DRAWINGS

An embodiment of the invention will be described in detail with reference to the following figures wherein:

FIG. 8 is a table summarizing a relationship between the ambient temperatures surrounding the print head and the driving pulses shown in FIGS. 7A to 7D;

FIG. 12 is a table showing a result of an experiment conducted to obtain appropriate relationships between temperatures and forms of pulse signals of driving waveforms of the ink droplet ejecting apparatus;

DETAILED DESCRIPTION OF PREFERRED EMBODIMENTS

An embodiment of the invention will be described with reference to the accompanying drawings. In the embodiment, the invention is applied to a piezoelectric ink jet print head.

Figure 1:
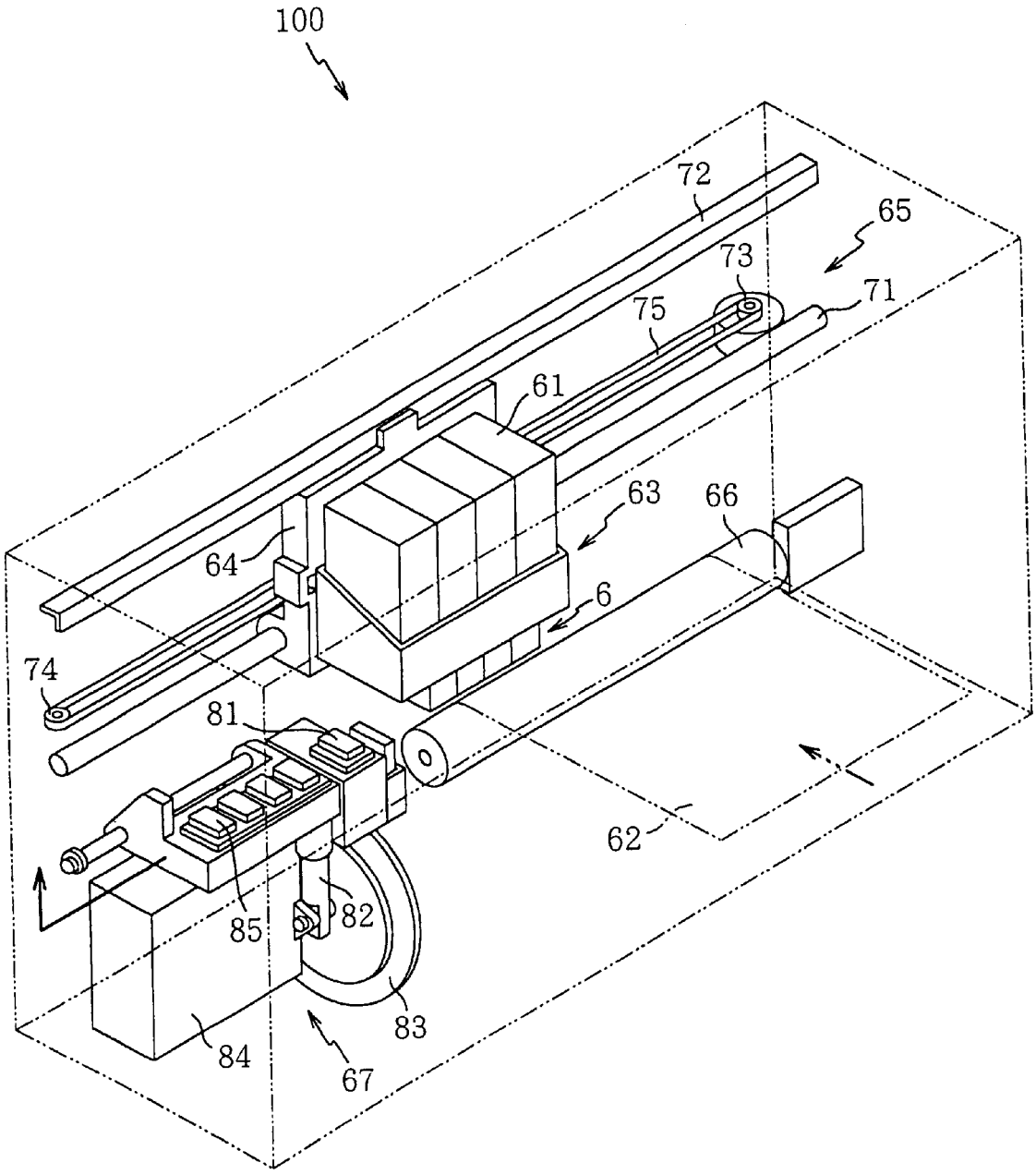
FIG. 1 is a perspective view showing a color ink jet printer having an ink jet printer head of an embodiment of the invention.

As shown in FIG. 1, a color ink jet printer 100 includes four ink cartridges 61, each of which contains a respective color of ink, such as cyan, magenta, yellow and black ink, a head unit 63 having an ink jet print head 6 (hereinafter referred to as a head 6) for printing indicia on a sheet 62, a carriage 64 on which the ink cartridges 61 and the head unit 63 are mounted, a drive unit 65 that reciprocates the carriage 64 in a straight line, a platen roller 66 that extends in a reciprocating direction of the carriage 64 and is disposed opposite to the head 6, and a purge unit 67.

The drive unit 65 includes a carriage shaft 71, a guide plate 72, two pulleys 73 and 74, and an endless belt 75. The carriage shaft 71 is disposed at a lower end portion of the carriage 64 and extends in parallel with the platen roller 66. The guide plate 72 is disposed at an upper end portion of the carriage 64 and extends in parallel with the carriage shaft 71. The pulleys 73 and 74 are disposed at both end portions of the carriage shaft 71 and between the carriage shaft 71 and the guide plate 72. The endless belt 75 is stretched between the pulleys 73 and 74.

As the pulley 73 is rotated in normal and reverse directions by a motor, the carriage 64, connected to the endless belt 75, is reciprocated in the straight direction, along the carriage shaft 71 and the guide plate 72, in accordance with the normal and reverse rotation of the pulley 73.

The sheet 62 is supplied from a sheet cassette (not shown) provided in the ink jet printer 100 and fed between the head 6 and the platen roller 66 to perform predetermined printing by ink droplets ejected from the head 6. Then, the sheet 62 is discharged to the outside. A sheet feeding mechanism and a sheet discharging mechanism are omitted from FIG. 1.

The purge unit 67 is provided on a side of the platen roller 66. The purge unit 67 is disposed to be opposed to the head 6 when the head unit 63 is located in a reset position. The purge unit 67 includes a purge cap 81, a pump 82, a cam 83, and a waste ink reservoir 84. The purge cap 81 contacts a nozzle surface to cover a plurality of nozzles (described later) formed in the head 6. When the head unit 63 is placed in the reset position, the nozzles in the head 6 are covered with the purge cap 81 to inhale ink including air bubbles trapped in the head 6 by the pump 82 and by the cam 83, thereby purging the head 6. The inhaled ink is stored in the waste ink reservoir 84.

To prevent ink from drying, a cap 85 is provided to cover the nozzles 15 (FIG. 2) in the head 6 mounted on the carriage 64 to be returned to the reset position after printing.

Figure 2:
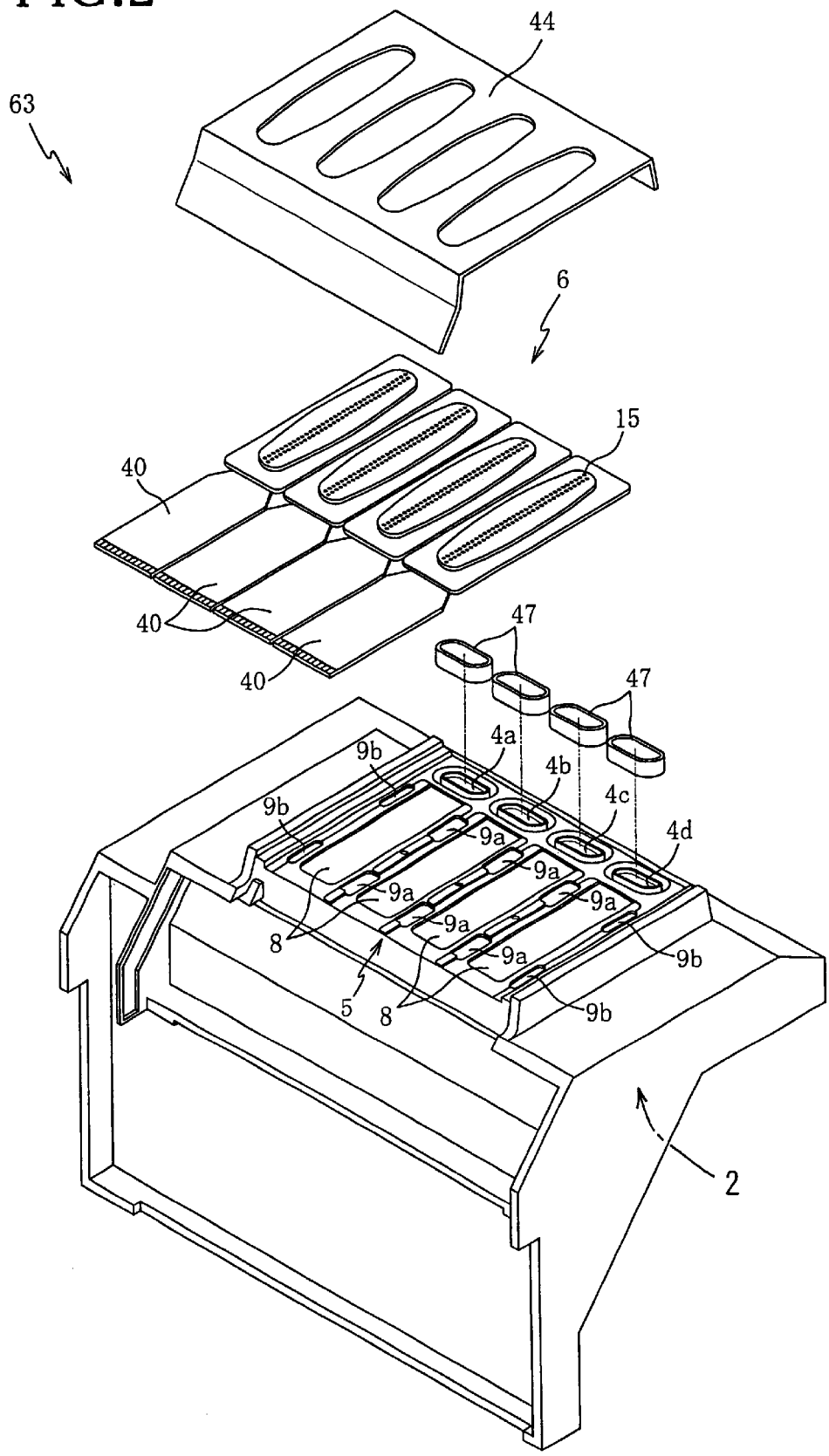
FIG. 2 is a perspective view of a head unit, with its nozzles facing upward.

As shown in FIG. 2, the head unit 63 is mounted on the carriage 64 that moves along the sheet 62 and has a substantially box shape with upper open structure. The head unit 63 has a cover plate 44 made of an elastic thin metallic plate. The cover plate 44 is fixed at the front surface of the head unit 63 and covers the head unit 63 when the head 6 is removed. The head unit 63 also has a mounting portion 2 on which the four ink cartridges 61 are detachably attached from above. Ink supply paths 4*a*, 4*b*, 4*c*, 4*d*, each of which connects respective ink discharge portions of each ink cartridge 61, communicate with a bottom of a bottom plate 5 of the head unit 63. Each of the ink supply paths 4*a*, 4*b*, 4*c*, 4*d* is provided with a rubber packing 47 to intimately contact an ink supply hole 19*a* (described later).

The head 6 is constructed from four blocks that are arranged in parallel to each other. On the underside of the bottom plate 5, four stepped supports 8 are formed to receive the respective blocks of the head 6. In the bottom plate 5, a plurality of recesses 9*a*, 9*b*, which are filled with an UV adhesive to bond the respective blocks of the head 6, are formed to penetrate the bottom plate 5.

Figure 3:
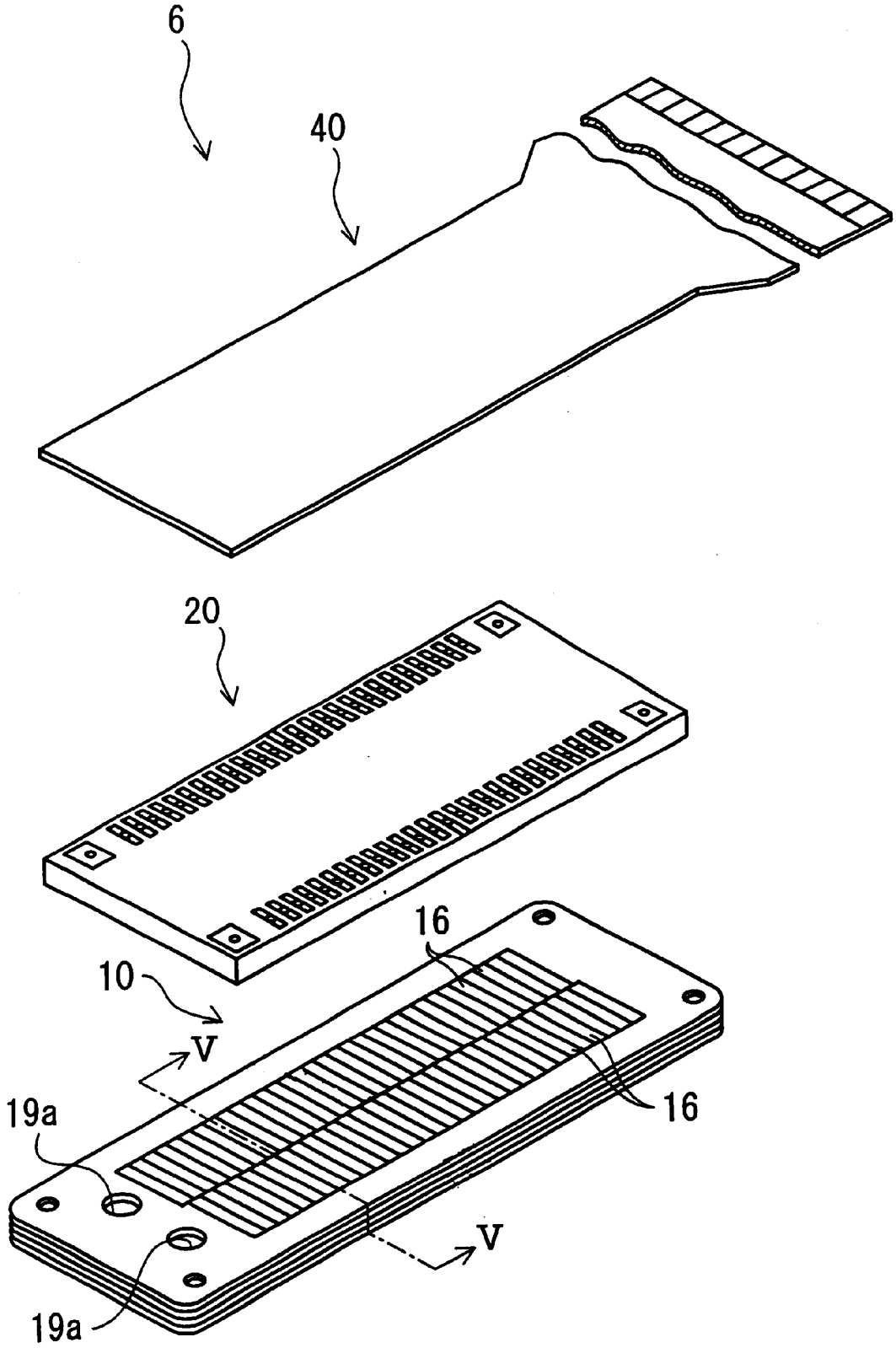
FIG. 3 is a perspective view showing parts of the ink jet print head.

Hereinafter, one of the blocks forming the head 6 will be described. Other blocks have a similar structure to the block described below. As shown in FIG. 3, the head 6 includes a laminated cavity plate 10, a plate-type piezoelectric actuator 20 that is bonded to the cavity plate 10 using an adhesive or an adhesive sheet, and a flexible flat cable 40 that is bonded using an adhesive to the upper surface of the piezoelectric actuator 20 for electric connection with external equipment. The nozzles 15 are formed on the underside of the cavity plate 10 at the bottom and ink is ejected downward therefrom.

The piezoelectric actuator 20 is constructed such that piezoelectric sheets, insulation sheets and drive electrodes are laminated. The piezoelectric actuator 20 is laminated on the upper surfaces of the pressure chambers 16 formed in the cavity plate 10. The piezoelectric actuator 20 is formed so that a direction of polarization in each piezoelectric sheet and a direction of an electric field to be applied via the drive electrodes become the same direction. As a voltage is applied, the piezoelectric actuator 20 deforms in the width direction, thereby reduce the internal volume of the pressure chambers 16 in the cavity plate 10.

Figure 4:
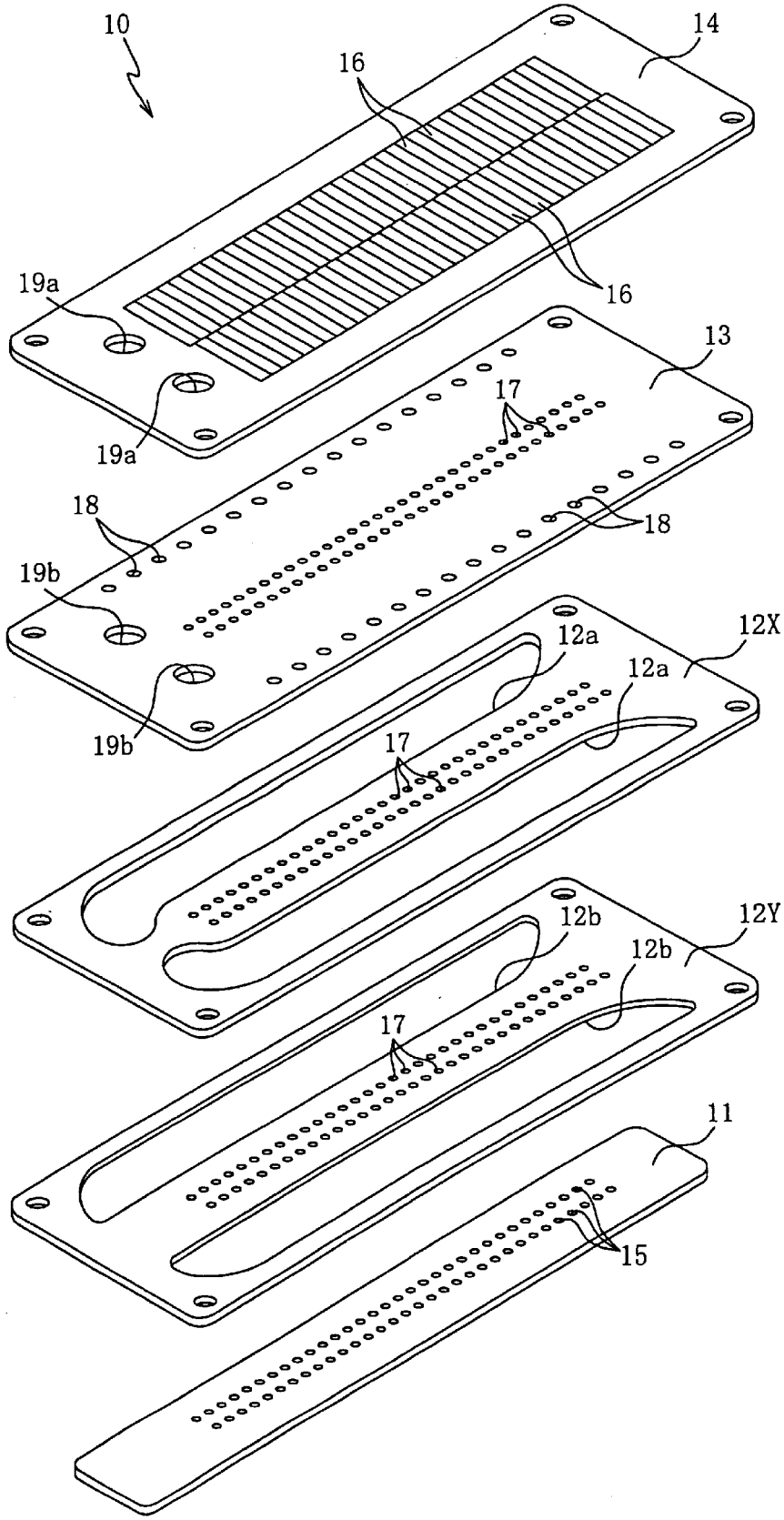
FIG. 4 is a disassembled perspective view showing a cavity plate.

The cavity plate 10 is constructed as shown in FIG. 4. Five thin metal plates, namely, a nozzle plate 11, two manifold plates 12X, 12Y, a spacer plate 13 and a base plate 14 are laminated in this order using an adhesive. In the embodiment, each of the plates 11 to 14 is a steel plate alloyed with 42% nickel, about 50–150 $\mu$m thick. These plates 11 to 14 may be formed of, for example, resins instead of metals.

Figure 5:
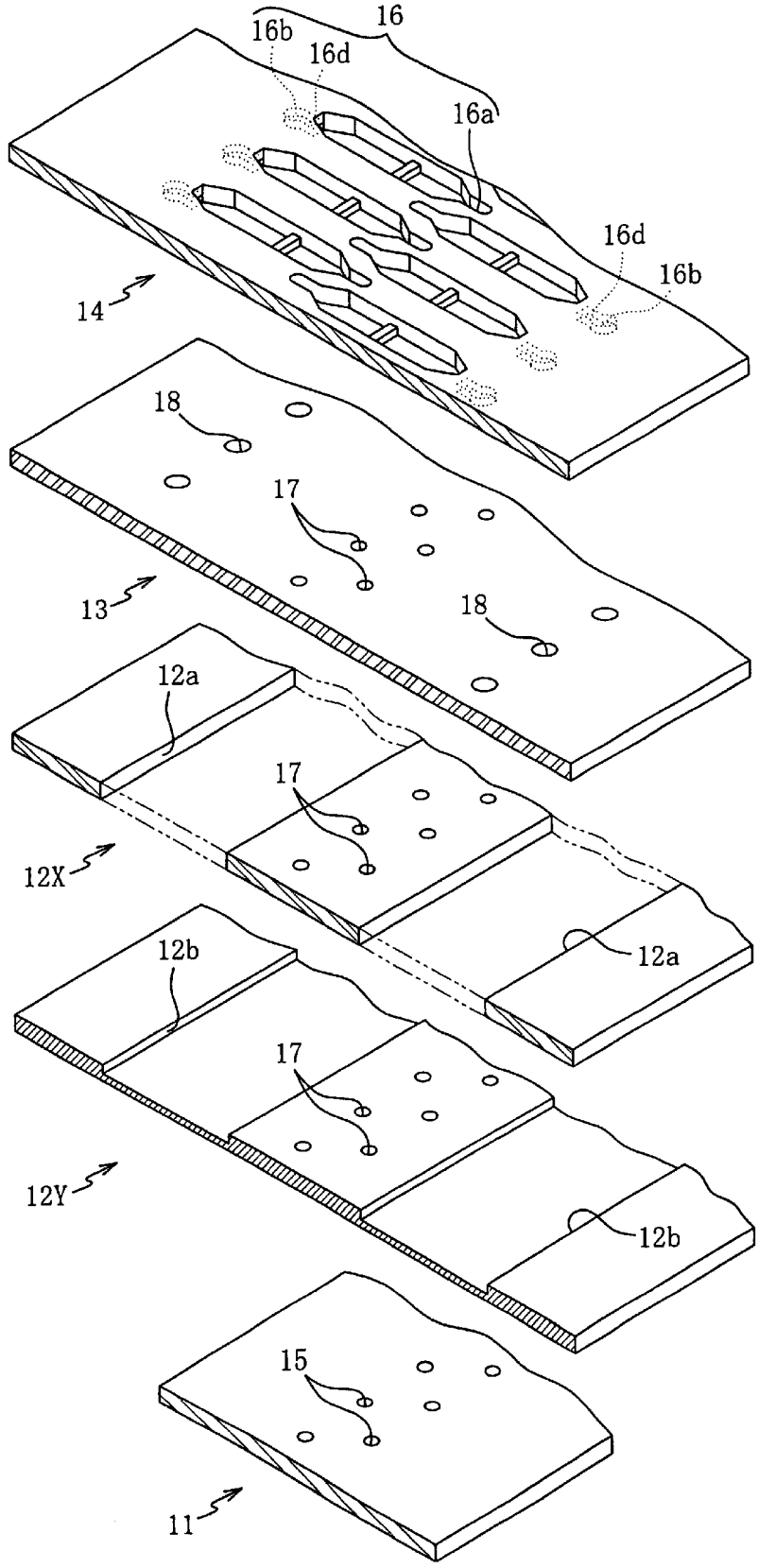
FIG. 5 is a disassembled enlarged perspective view showing the cavity plate, taken along line V–V in FIG. 3, looking in the direction of the appended arrows.

As shown in FIG. 5, in the base plate 14, a plurality of narrow pressure chambers 16 are provided, in a staggered configuration, to extend in a direction perpendicular to a longitudinal direction of the base plate 14. The base plate 14 has recessed narrowed portions 16*d* connected with the respective pressure chambers 16 and recessed ink inlets 16*b* connected with the respective narrowed portions 16*d*, in the surface on the side of the spacer plate 13. The ink inlets 16*b* communicate with respective common ink chambers 12*a* formed in the manifold plate 12X, via ink supply holes 18 formed on right and left side portions of the spacer plate 13. A cross-sectional area of each narrowed portion 16*d* perpendicular to an ink flow direction is smaller than that of each pressure chamber 16. By doing so, the resistance to the flow of ink can be increased.

An ink outlet 16*a* of each pressure chamber 16 is provided to be aligned with an associated one of the nozzles 15 in the nozzle plate 11. The ink outlets 16*a* communicate with the spacer spate 13 and the manifold plates 12X, 12Y, via through holes 17 having an extremely small diameter and formed in the staggered configuration similarly to the nozzles 15.

As shown in FIG. 4, in the base plate 14 and the spacer plate 13, two ink supply holes 19*a* and 19*b* are formed, respectively, to supply ink from a common ink cartridge to the two common ink chambers 12*a* in the manifold plate 12X.

The ink supply holes 19*a* in the base plate 14 are formed near the rows of the pressure chambers 16 to reduce the size of the head 6. Ink is supplied from a common ink cartridge to the ink supply holes 19*a*, so that the ink supply holes 19*a* are provided adjacent to each other. The ink supply holes 19*a* supply ink to the common ink chambers 12*a* via the two ink supply holes 19*b* formed in the spacer plate 13. However, one ink supply hole 19*a* may be enough for supplying ink unless two ink supply holes 19*b* are formed in the spacer plate 13.

In the manifold plates 12X, 12Y, as shown in FIG. 4, two common ink chambers 12*a*, 12*b* are provided, respectively, on both sides of the rows of the nozzles 15 in the nozzle plate 11. The common ink chambers 12*a*, 12*b* are formed to extend in parallel with a direction of alignment of the plurality of pressure chambers 16 and are provided at a lower portion of the cavity plate 10, that is, on the side near the nozzles 15 formed in the nozzle plate 11.

In the manifold plate 12X provided on the side of the spacer plate 13, the common ink chambers 12*a* are formed to penetrate the manifold plate 12X. In the manifold plate 12Y provided on the side of the nozzle plate 11, the recessed common ink chambers 12*b* are opened toward the side of the manifold plate 12X. The two manifold plates 12X and 12Y and the spacer plate 13 are laminated in this order from above. With this structure, the common ink chambers 12*a* and 12*b* overlap each other, thereby forming two manifolds 12 (FIG. 6) on both sides of the rows of through holes 17. Accordingly, ink to be supplied to the pressure chambers 16 can be sufficiently obtained. Because the pressure chambers 16 are aligned in two rows, the two manifolds 12 are provided on both sides of the rows of the through holes 17 with respect to the pressure chambers 16.

In the nozzle plate 11, the plurality of nozzles 15 having an extremely small diameter (the order of 25 $\mu$m in diameter in this embodiment) are provided with a small pitch P, in a staggered configuration, along a longitudinal direction of the nozzle plate 11.

With the structure of the cavity plate 10 as described above, ink flows in the manifolds 12 from the ink supply holes 19*a*, 19*b* formed in the base plate 14 and the spacer plate 13 at their one end, and then the ink is distributed to the pressure chambers 16 from the manifolds 12 via the ink supply holes 18, the ink inlets 16, and the narrowed portions 16*d*. Then, in each of the pressure chambers 16, the ink flows toward the ink outlet 16*a*, and thus the ink reaches the nozzles 15 with respect to the pressure chambers 16 via the through holes 17.

Figure 6:
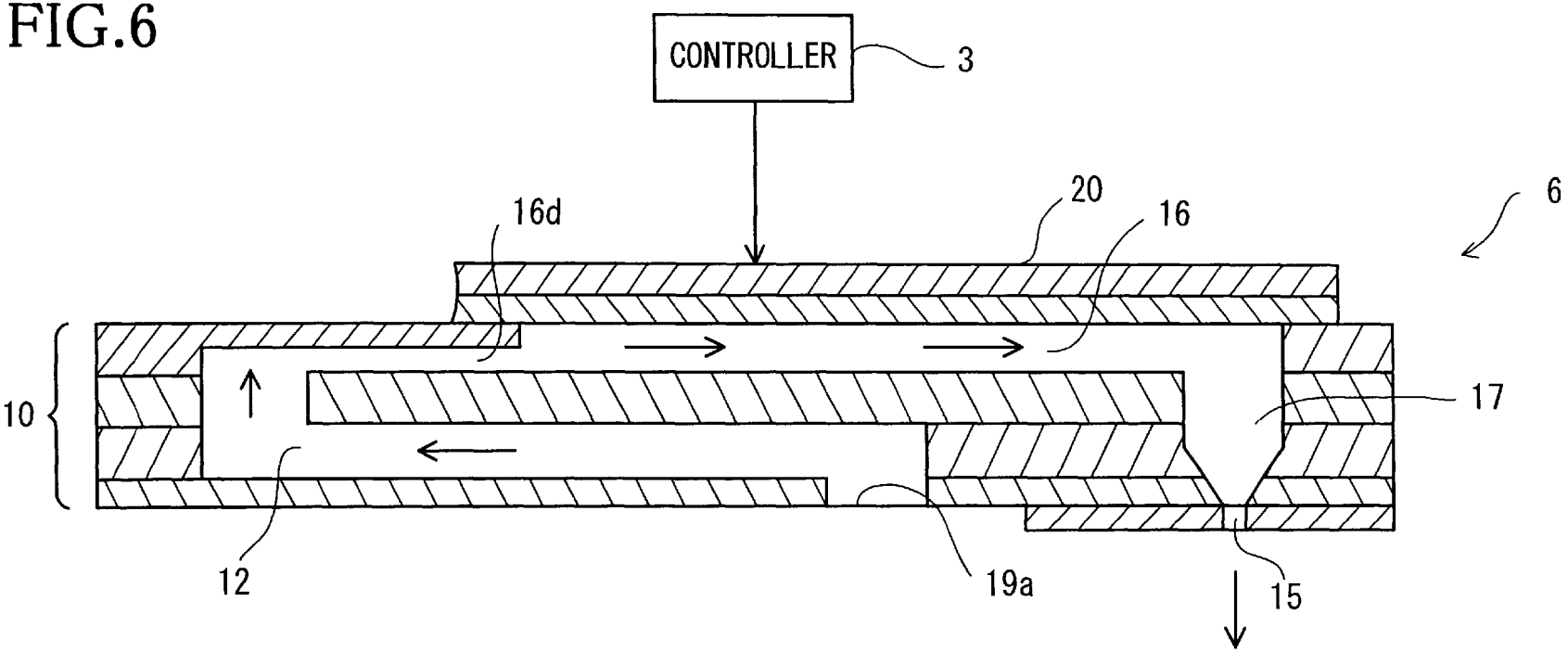
FIG. 6 is a schematic diagram showing the ink jet print head and a controller.

FIG. 6 is a sectional view showing one of the pressure chambers in the head 6. As shown in FIGS. 1 to 5, the plurality of pressure chambers 16 are provided in the head 6. The nozzle 15 communicating the respective pressure chambers 16 are provided substantially in line in one surface of the head 6.

As shown in FIG. 6, the head 6 is constructed by the cavity plate 10 and the piezoelectric actuator 20. The cavity plate 10 has the ink supply holes 19*a* connected with ink supply source, the manifolds 12, the narrowed portions 16*d*, the pressure chambers 16, the through holes 17 and the nozzles 15, which communicate with each other. While the ink supply hole 19*a* opens toward the ejecting direction of the nozzle 15 in FIG. 6 for convenience, the ink supply hole 19*a* actually opens toward the piezoelectric actuator 20 as shown in FIGS. 1 to 5.

A controller 3 provides a prestored driving pulse to the piezoelectric actuator 20 by superimposing the driving pulse on a clock signal. The details of the driving pulse will be described later.

When a driving pulse is applied by the controller 3 to a driving electrode provided on the piezoelectric actuator 20, the electrostrictive effects of the piezoelectric sheets develop deformation in the laminating direction. The internal volume of the pressure chamber 16, corresponding to the driving electrode, is reduced by the pressure produced due to the deformation. As a result, the ink in the pressure chamber 16 is ejected from the respective nozzle 15 and thus printing is performed.

In the head 6 of the embodiment, ink ejection is performed by application of voltage to the piezoelectric actuator 20 as described below.

While the printing is not performed, the pressure chamber 16 is in a state where its internal volume is reduced by applying a voltage to the piezoelectric actuator 20. Only when ink ejection is allowed to be performed, the application of voltage is released to recover the internal volume of the pressure chamber 16. After the internal volume of the pressure chamber 16 is recovered and the ink is supplied to the pressure chamber 16, the voltage is applied to reduce the internal volume of the pressure chamber 16. By doing so, with the reduction of the internal volume of the pressure chamber 16, the ink is ejected to the outside of the head 6 via the nozzle 15.

As described above, the head 6 of this embodiment supplies ink when a printing command is issued, and immediately afterward, the internal volume of the pressure chamber 16 is reduced to perform ink ejection. Particularly, a pressure wave developed due to the reduction of the internal volume of the pressure chamber 16 is superimposed on a reflected wave of a pressure wave developed in the ink when the ink is supplied, so that an ink droplet that has a predetermined diameter and ejecting speed can be appropriately and effectively ejected with application of a low voltage.

At that time, the ink flow path is constructed by the ink supply holes 19*a*, the manifolds 12, the narrowed portions 16*d*, the pressure chambers 16, the through holes 17, and the nozzles 15, in this order from the upstream direction.

When the ink is ejected through the ink flow path described above, the pressure wave developed in the pressure chamber 16 reflects at an end of the pressure chamber 16 and oscillates at predetermined intervals. Therefore, when a dot having a desirable density is formed by which several driving pulses are successively supplied with respect to one dot, the pressure wave oscillation in the pressure chamber 16 becomes complicated. Thus, there may be a case where the residual pressure is difficult to reduce.

In this embodiment, the controller 3 supplies driving pulses as described below. Specifically, in this embodiment, the construction of input pulses are controlled according to ambient temperature surrounding the head 6.

The input pulses to be supplied at between low and middle temperatures, that is, lower than 30 degree Celsius, are constructed as described below. It is assumed that a cycle of a pressure wave in the pressure chamber is T and a value of T/2, that is, an one-way propagation time of a pressure wave in the pressure chamber, is AL. When two pulses are provided as a driving pulse, a pulse output period that is a time between application of a first pulse and application of a second pulse is set to 5AL, as shown in FIG. 7A.

Figure 9:
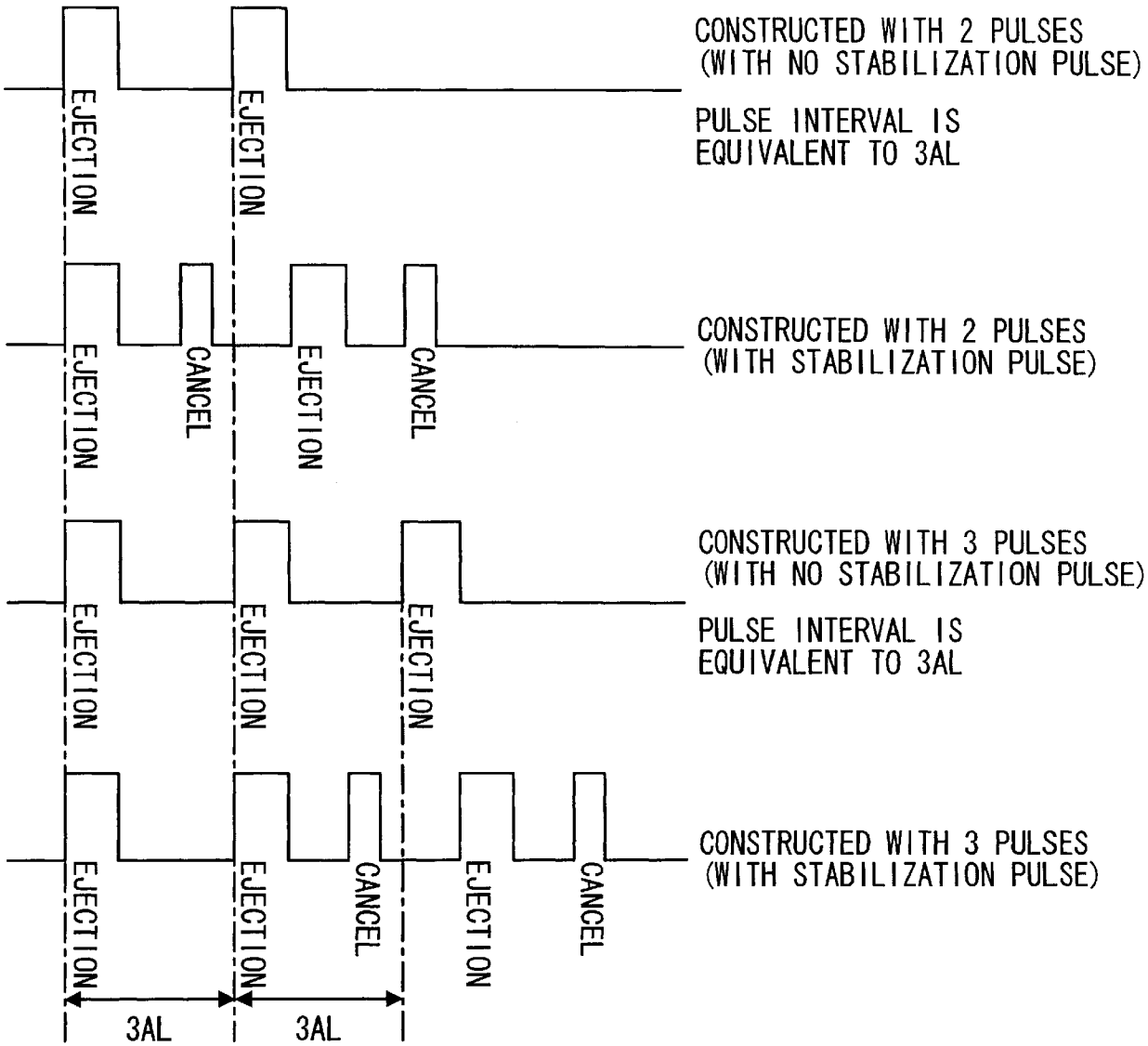
FIG. 9A is a diagram showing an example that two conventional driving pulses are applied, with respect to one dot, without a stabilization pulse.
FIG. 9B is a diagram showing an example that two conventional driving pulses are applied, with respect to one dot, with the stabilization pulse.
FIG. 9C is a diagram showing an example that three conventional driving pulses are applied, with respect to one dot, without the stabilization pulse.
FIG. 9D is a diagram showing an example that three conventional driving pulses are applied, with respect to one dot, with the stabilization pulse.

By supplying the pulses at the pulse output period of 5AL as described above, the residual pressure is further reduced as compared with a case where driving pulses are supplied at a pulse output period of 3AL as shown in FIG. 9A. Thus, a subsequent ink droplet can be stably ejected with the appropriately reduced residual pressure. Accordingly, though ink droplets are successively ejected, the ink ejection can be stably performed without a stabilization pulse (cancel pulse). This has been proved by experiment. The experimental result is shown in FIG. 12. In the table, ○ indicates that no problem occurs at the time of ink ejection. Δ indicates that a problem rarely occurs at the time of ink ejection. X indicates that a repeatable problem always occurs at the time of ink ejection. When the ambient temperature surrounding the head 6 is between low and middle, the viscosity of the ink is relatively high. Therefore, the residual pressure is apt to decrease. Thus, the pulse output period of 5AL of the embodiment is effective. With this driving pulse construction, the number of required pulses is reduced, and the ink droplet ejection apparatus becomes insensitive to variations in the ink ejection characteristics due to variations in the quality of the heads 6. Further, the shape of printed dots nearly became a circle.

When the ambient temperature surrounding the head 6 is high, that is, 30 degrees Celsius or higher, the residual pressure in the pressure chamber remains without itself being reduced. Therefore, as shown in FIG. 7B, a stabilization pulse (cancel pulse) is applied at a timing that the oscillation of the residual pressure is almost antagonized. The stabilization pulse does not cause an ink droplet to be ejected. That is, the construction of the pulses of the embodiment is similar to that shown in FIG. 9B.

Figure 7:
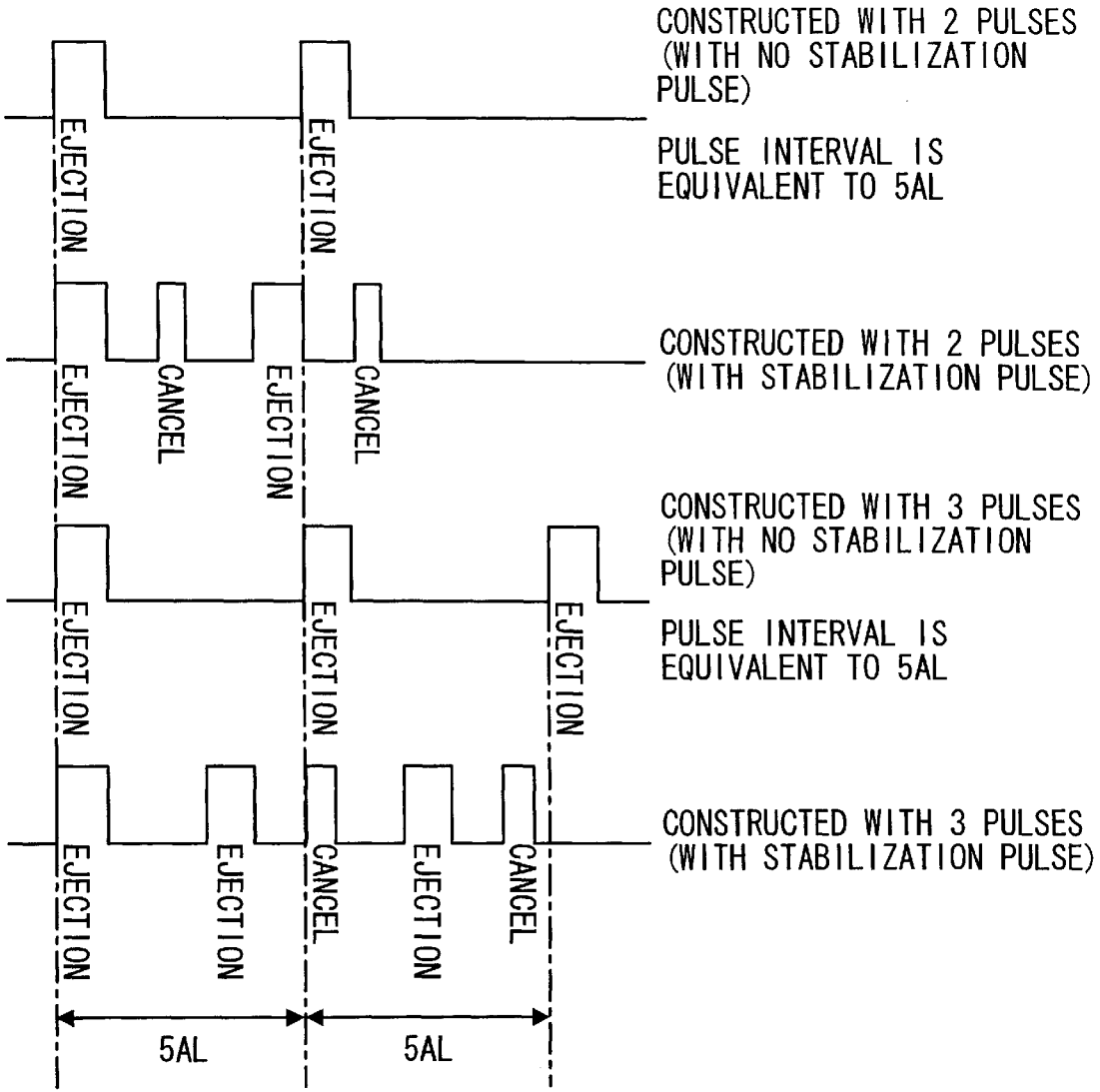
FIG. 7A is a diagram showing an example that two driving pulses are applied, with respect to one dot, by the controller, when the ambient temperature surrounding the print head is between low and medium.
FIG. 7B is a diagram showing an example that two driving pulses are applied, with respect to one dot, by the controller, when the ambient temperature surrounding the print head is high.
FIG. 7C is a diagram showing an example that three driving pulses are applied, with respect to one dot, by the controller, when the ambient temperature surrounding the print head is between low and medium.
FIG. 7D is a diagram showing an example that three driving pulses are applied, with respect to one dot, by the controller, when the ambient temperature surrounding the print head is high.

When the ambient temperature surrounding the head 6 is between low and medium and ejection of a single dot is constructed with three pulses, as shown in FIG. 7C, the pulse output period between application of a first pulse and a second pulse and between application of the second pulse and a third pulse is both set to 5AL.

By supplying the pulses at the pulse output period of 5AL as described above, the residual pressure is further reduced as compared with a case where the pulses are supplied at the pulse output period of 3AL as shown in FIG. 9C. Thus, a subsequent ink droplet can be stably ejected with the appropriately reduced residual pressure. Accordingly, though ink droplets are successively ejected, the ink ejection can be stably performed without the stabilization pulse (cancel pulse). With this driving pulse construction, the number of required pulses are reduced and the ink droplet ejection apparatus becomes insensitive to variations in the ink ejection characteristics due to variations in the quality of the heads 6. Further, the shape of printed dots nearly became a circle.

When the ambient temperature surrounding the head 6 is between high and ejection of a single dot is constructed with three pulses, the residual pressure in the pressure chamber remains without itself being reduced. Accordingly, as shown in FIG. 7D, the stabilization pulse (cancel pulse) is applied. That is, the construction of the pulses of the embodiment is similar to that shown in FIG. 9D.

The construction of the driving pulses according to the ambient temperature surrounding the head 6 in the embodiment described above is shown in FIG. 8. FIGS. 7A to 7D and 9A to 9D do not suggest a peak voltage of a driving waveform of each pulse, but show the construction of the driving pulses, the pulse output period and the timing of pulse application. That is, in FIGS. 7A to 7D, while the peak voltage of the driving waveform of each pulse is indicated as if they are constant, the peak voltage is actually changed according to the ambient temperature. This is traceable to the variations in the viscosity of the ink with temperature. More specifically, a high voltage is applied if the ambient temperature is low, and a low voltage is applied if the ambient temperature is high.

Figure 13A:
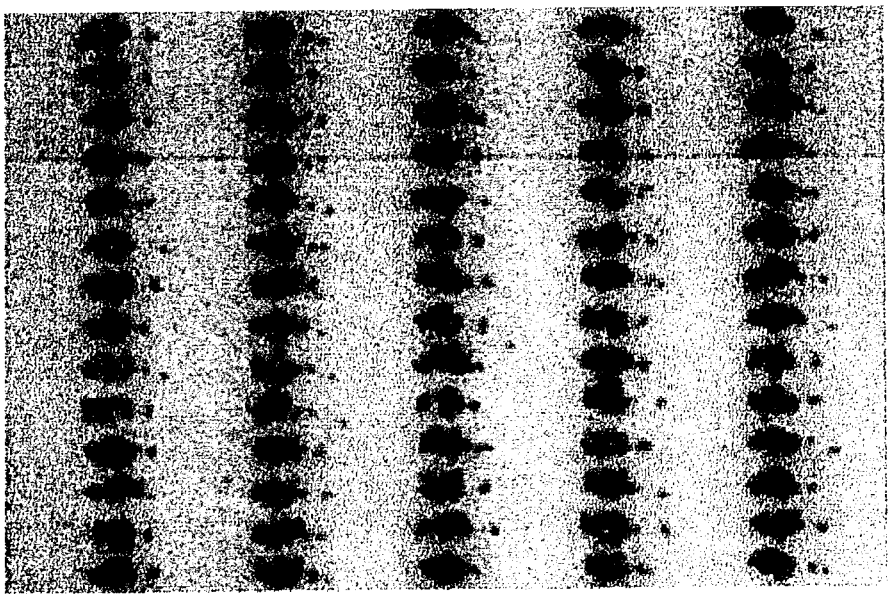
FIG. 13A illustrates results of printing performed using a conventional ink droplet ejecting apparatus.
Figure 13B:
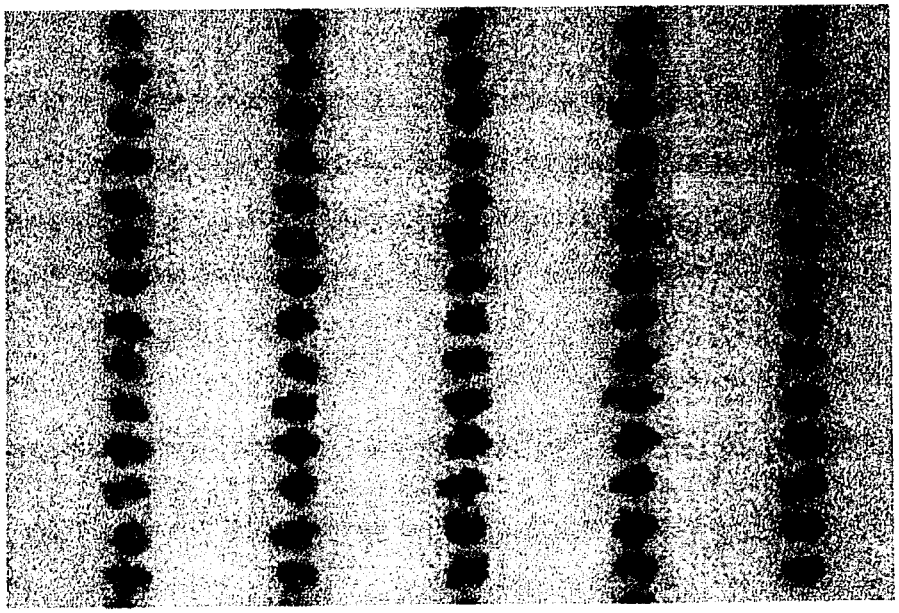
FIG. 13B illustrates results of printing performed using the ink droplet ejecting apparatus of the embodiment.

FIG. 13A shows results of printing performed by a conventional ink droplet ejecting apparatus. FIG. 13B shows results of printing performed by the ink droplet ejecting apparatus of the embodiment of the invention.

According to the pulse construction of the embodiment, printing quality and ejection stability can be improved at the low and medium temperatures. As opposed to this, according to the conventional driving pulse construction as shown in FIGS. 9A to 9D, satellite ink droplets may be produced or printed dots may be deformed.

Figure 10:
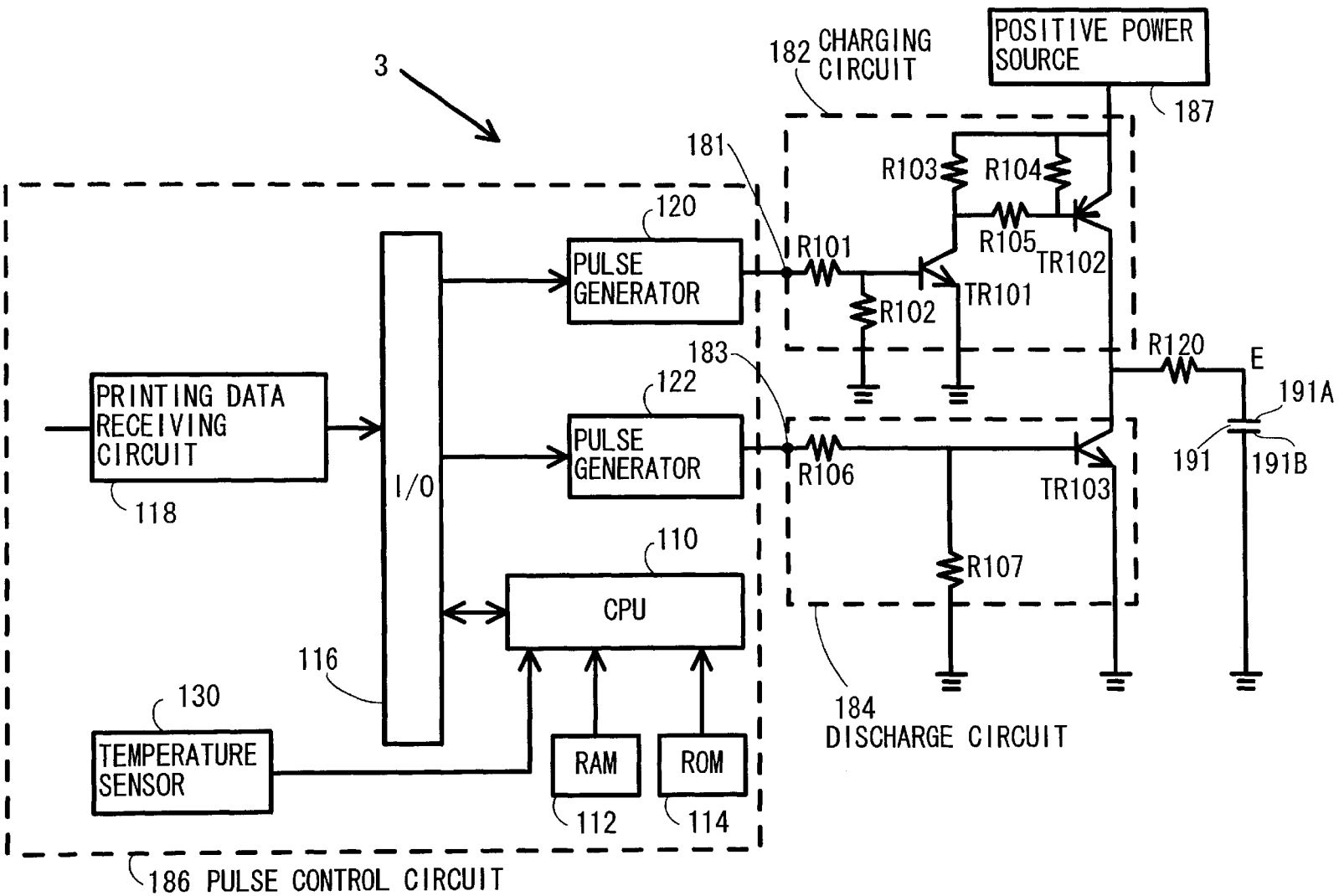
FIG. 10 is a block diagram showing a drive circuit provided in an ink droplet ejecting apparatus.

As shown in FIG. 10, the controller 3 includes a charging circuit 182, a discharge circuit 184 and a pulse control circuit 186. A piezoelectric material of the piezoelectric actuator 20 and electrodes are equivalently represented by a capacitor 191. Reference numerals 191A and 191B denote terminals of the capacitor 191.

Input pulse signals are input into input terminals 181, 183. These input pulse signals are used to set voltages supplied to the electrode provided in the piezoelectric actuator 20 to E (V) and 0 (V), respectively. The charging circuit 182 includes resistors R101, R102, R103, R104, R105, and transistors TR101, TR102.

When an ON signal (+5 V) is input to the input terminal 181, the transistor TR101 is controlled through the resistor R101 so that a current flows from positive power supply 187 through the resistor R103 to the transistor TR101 along the collector to the emitter direction. Therefore, divided voltages of the voltage applied to the resistors R104 and R105 connected to the positive power supply 187 are raised and a current that flows in the base of the transistor TR102 increases, thereby controlling the emitter-collector path of the transistor TR102. A voltage 20 (V) from the positive power source 187 is applied through the collector and the emitter of the transistor TR102 and the resistor R120 to the capacitor 191 at the terminal 191A.

The discharge circuit 184 includes resistors R106, R107 and a transistor TR103. When an ON signal (+5 V) is input to the input terminal 183, the transistor TR103 is controlled through the resistor R106, thereby resulting in the terminal 191A on the side of a resistor R120 of the capacitor 191 being connected to the ground through the resistor R120. Therefore, electric charges applied to the piezoelectric actuator 20 of the pressure chamber 16, shown in FIG. 6, are discharged.

Figure 11:
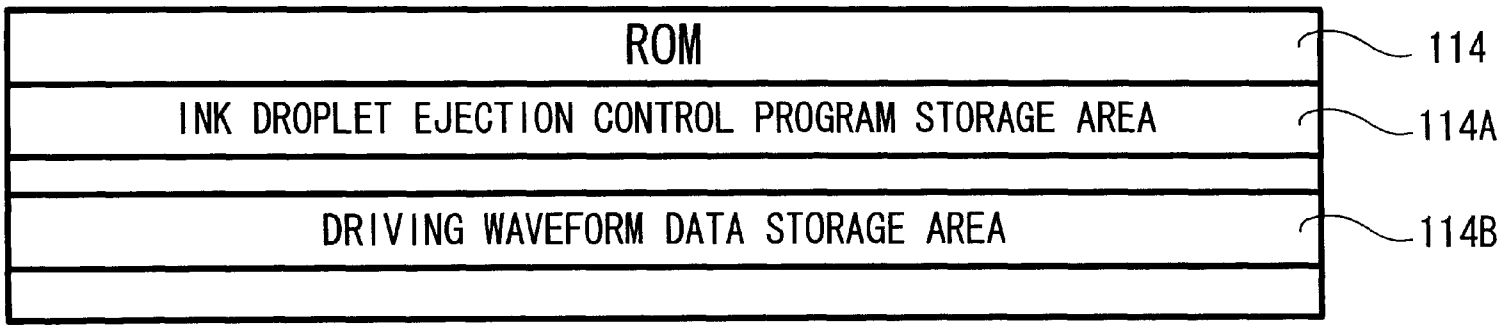
FIG. 11 is a diagram showing a storage area of a ROM of the controller provided in the ink droplet ejecting apparatus.

The pulse control circuit 186 generates pulse signals that are input to the input terminal 181 of the charging circuit 182 and the input terminal 183 of the discharging circuit 184. The pulse control circuit 186 is provided with a CPU 110 for performing a variety of computations. To the CPU 110, there are connected a RAM 112 for memorizing sequence data in which on/off signals are generated in accordance with a control program and a timing of the pulse control circuit 186. The ROM 114 includes, as shown in FIG. 11, an ink droplet jet control program area 114A and a driving waveform data storage area 114B. The sequence data of the driving waveform 10 is stored in the driving waveform data storage area 114B.

Further, the CPU 110 is connected to an input/output (I/O) bus 116 for exchanging a variety of data, and a printing data receiving circuit 118 and pulse generators 120 and 122 are connected to the I/O bus 116. An output from the pulse generator 120 is connected to the input terminal 181 of the charging circuit 182 and an output from the pulse generator 122 is connected to the input terminal 183 of the discharging circuit 184.

Based on the output result from a temperature sensor 130, the CPU 110 controls the pulse generators 120 and 122 in accordance with the sequence data memorized in the driving waveform data storage area 114B. Therefore, by memorizing various kinds of patterns of the above-mentioned timing in the driving waveform data storage area 114B within the ROM 114 in advance, it is possible to supply the driving pulse of the driving waveform shown in FIGS. 7A to 7D to the piezoelectric actuator 20. The quantity of each of the pulse generators 120, 122, the charging circuit 182 and the discharging circuit 184 are equal to the number of nozzles in an apparatus. Therefore, while this embodiment typically describes the manner in which one nozzle is controlled, other nozzles are controlled similarly as described above.

In this embodiment, the ambient temperature surrounding the head 6 is divided into three ranges. However, it can be divided into more narrow ranges, such as four or five ranges.

The detailed setting of each temperature range varies depending on characteristics of ink to be used. However, as a guide, when typical water base ink is used, it is preferred that a boundary between a low temperature area and a medium temperature area is set between 10 and 20 degrees Celsius (preferably approximately 15 degrees Celsius) and that between a medium temperature and a high temperature is set between 25 and 35 degrees Celsius (preferably approximately 30 degrees Celsius).

While the piezoelectric actuator 20 is used in this embodiment, others can be used instead of the piezoelectric actuator 20 as long as they can change the volume of the pressure in the pressure chambers. In the embodiment, the invention is applied to the head 6 in which the pressure chambers are covered with the actuator. However, the invention can be applied to ink jet heads having different structure from the embodiment, such as a head in which a wall of a cavity plate forming pressure chambers is formed of an actuator.

Although the invention has been described in detail with reference to a specific embodiment thereof, it would be apparent to those skilled in the art that various changes and modifications may be made therein without departing from the spirit of the invention.

What is claimed is:

1. A method for ejecting an ink droplet from an inkjet head provided in an ink droplet ejecting apparatus, the inkjet head including an actuator and a cavity plate having a pressure chamber for ejecting an ink droplet, comprising:

applying a driving pulse to the actuator to generate a pressure wave in the pressure chamber, wherein an output period of a sequence of driving pulses is set to be five times of a time AL (5 AL), where AL is the time in which a pressure wave propagates one-way within the ink chamber, when the sequence of the driving pulses are successively applied to the actuator to form one dot with a plurality of ink droplets in accordance with a printing command, residual pressure is reduced so that a second ink droplet is stably ejected in the appropriately reduced residual pressure and the implementation of setting the output period of the driving pulses to be 5 AL is determined based on data regarding ink temperature in the inkjet head.

2. The method according to claim 1, wherein the output period of the driving pulses is set to be 5 AL when the ink temperature data indicates that the ink temperature is between low and medium.

3. The method according to claim 2, wherein the output period of the driving pulses is set to be 5 AL when the ink temperature data indicates that the ink temperature is 30 degree Celsius or lower.

4. The method according to claim 1, wherein the ink temperature data is data related to ambient temperature surrounding the inkjet head.

5. The method according to claim 1, wherein an output of a stabilization pulse that does not cause the ejection of the ink droplet is omitted in the driving pulses when the output period of the driving pulses is set to be 5 AL.

6. The method according to claim 2, wherein the output period of the driving pulses is three times of AL (3 AL)or shorter and a stabilization pulse for nonejection of the ink droplets is added following to the driving pulses when the ink temperature data indicates that the ink temperature is high.

7. The method according to claim 1, wherein the actuator consists of a piezoelectric element.

8. The method according to claim 7, wherein the ink droplet is ejected with a pressure wave in the pressure chamber generated by which a volume of the pressure chamber is increased once from a normal volume state by applying the driving pulse to the actuator and then the volume is reduced to the normal volume state.

9. The method according to claim 1, wherein the driving pulse has a pulse length of substantially 1 AL.

10. An ink droplets ejecting apparatus, comprising:

a inkjet head including a pressure chamber that contains ink, a nozzle that communicates with the pressure chamber and can eject an droplet of ink contained in the pressure chamber and an actuator that changes a volume of the pressure chamber;

a temperature detector that detects a temperature of the ink in the inkjet head;

a driving pulse generator that generates a driving pulse to be applied to the actuator; and a controller that allows the nozzle to eject an ink droplet therefrom by selectively applying the driving pulse generated by the driving pulse generator to the actuator to generate a pressure wave in the pressure chamber, wherein the controller sets an output period of a sequence of driving pulses to be five times of a time AL (5 AL), where AL is the time in which a pressure wave propagates one-way within the ink chamber, when the sequence of the driving pulses are successively applied to the actuator to form one dot with a plurality of ink droplets in accordance with a printing command, and the controller receives the ink temperature data and determines whether the setting of the output period of the driving pulses to be 5 AL is performed based on the ink temperature data.

11. The ink droplet ejecting apparatus according to claim 10, wherein the controller sets the output period of the driving pulses to be 5 AL when the ink temperature data indicates that the ink temperature is between low and medium.

12. The ink droplet ejecting apparatus according to claim 1, wherein the controller sets the output period of the driving pulses to be 5 AL when the ink temperature data is indicates that the ink temperature is 30 degree Celsius or lower.

13. The ink droplet ejecting apparatus according to claim 10, wherein the temperature detector detects ambient temperature surrounding the inkjet head.

14. The ink droplet ejecting apparatus according to claim 10, wherein the controller allows the driving pulse generator to output the driving pulses without a stabilization pulse for nonejection of the ink droplet when the driving pulses is applied to the actuator at the output period of 5 AL.

15. The ink droplet ejecting apparatus according to claim 10, wherein the controller applies the driving pulse at an output period of the driving pulses that is three times of AL (3 AL) or shorter and a stabilization pulse for nonejection of the ink droplet following to the driving pulse when the ink temperature data indicates that the ink temperature is high.

16. The ink droplet ejecting apparatus according to claim 10, wherein the actuator consists of a piezoelectric element.

17. The ink droplet ejecting apparatus according to claim 16, wherein the actuator ejects an ink droplet with a pressure wave in the pressure chamber generated by which a volume of the pressure chamber is increased once from a normal volume state by applying the driving pulse to the actuator and then the volume is reduced to the normal volume state.

18. The ink droplet ejecting apparatus according to claim 10, wherein the driving pulse generator generates the driving pulse that has a pulse length of substantially 1 AL.

19. A method for ejecting an ink droplet from an inkjet head provided in an ink droplet ejecting apparatus, the inkjet head including an actuator and a cavity plate having a pressure chamber for ejecting an ink droplet, comprising:

applying a driving pulse to the actuator to generate a pressure wave in the pressure chamber, wherein an output period of a sequence of driving pulses is set to be five times of a time AL (5 AL), where AL is the time in which a pressure wave propagates one-way within the ink chamber, when the sequence of the driving pulses are successively applied to the actuator to form one dot with a plurality of ink droplets in accordance with a printing command, and the implementation of setting the output period of the driving pulses to be 5 AL is determined based on data regarding ink temperature in the inkjet head.

* * * * *